US007243806B2

(12) United States Patent
Kwok

(10) Patent No.: US 7,243,806 B2
(45) Date of Patent: Jul. 17, 2007

(54) BATHROOM RAIL

(75) Inventor: Chin-Pang Kwok, Hong Kong (HK)

(73) Assignee: Golden Peak Plastic Works Limited, Kowloon, Hong Kong (CN)

( * ) Notice: Subject to any disclaimer, the term of this patent is extended or adjusted under 35 U.S.C. 154(b) by 374 days.

(21) Appl. No.: 10/910,875

(22) Filed: Aug. 4, 2004

(65) Prior Publication Data

US 2006/0026748 A1 Feb. 9, 2006

(51) Int. Cl.
*A47H 1/08* (2006.01)

(52) U.S. Cl. ..... 211/105.3; 248/206.3; 248/220.1

(58) Field of Classification Search ..... 4/558, 4/559, 571.1, 573.1, 576.1, 577.1, 597, 605, 4/608, 610, 578.1, 579; 211/105.3, 105.4, 211/105.5, 105.6; 248/205.5, 206.3, 220.1, 248/205.6; 224/482
See application file for complete search history.

(56) References Cited

U.S. PATENT DOCUMENTS 4,037,726 A * 7/1977 Schweers ..... 211/105.5
5,025,919 A * 6/1991 Brinker et al. ..... 224/482 X
5,491,850 A * 2/1996 Kiester ..... 4/579 X
5,606,751 A * 3/1997 Baker ..... 4/578.1 X
6,502,794 B1 * 1/2003 Ting ..... 248/205.5 X

* cited by examiner

*Primary Examiner*—Robert M. Fetsuga
(74) *Attorney, Agent, or Firm*—Alix, Yale & Ristas, LLP

(57) ABSTRACT

A bathroom rail assembly includes a rail having opposed ends, each of which is attached to a respective suction fastening device by which the rail assembly can be attached to a fixed surface.

6 Claims, 1 Drawing Sheet

BATHROOM RAIL

BACKGROUND OF THE INVENTION

The present invention relates to bathroom or laundry rails. More particularly, although not exclusively, the invention relates to a telescopic rail that can be fixed at both ends to bathroom, laundry or kitchen wall tiles using suction cup fastening devices.

It is of course known to attach bathroom rails to bathroom walls using fixtures at each end of the rail. These fixtures are permanently attached to the bathroom wall by screws, tile adhesive and/or other known means. A problem exists in small bathrooms for example, where there is little room for handrails. It might be desirable for example to temporarily attach a rail to tiles above a bath tub and/or within a shower recess—say for the purpose of attaching clothes to hang and dry. A permanent fixture in such a location would be inconvenient for general use of the shower recess and/or bath tub.

OBJECTS OF THE INVENTION

It is an object of the present invention to overcome or substantially ameliorate the above disadvantage and/or more generally to provide a bathroom rail for temporary fixture at both of its ends to wall tiles or a glass pane.

DISCLOSURE OF THE INVENTION

There is disclosed herein a rail assembly comprising a rail having opposed ends, each of which is attached to a respective suction fastening device by which the rail assembly can be attached to a fixed surface.

Preferably the assembly comprises two or more telescopically interacting tubular members.

Preferably, the suction fastening devices are pivotally attached to the rail.

Preferably, each suction fastening device has attached pivotally thereto an intermediate link that is in turn attached pivotally to a respective one is said opposed ends of the rail.

Preferably, each intermediate link comprises a pair of opposed pivot pins—one at each end thereof, one pin serving to attach the link to a respective said suction fastening device and the other pin serving to attach the link to the respective said rail end.

Preferably, the respective axes of the pivot pins are angularly offset from one another.

More preferably, the angular offset is approximately 90 degrees.

Preferably, the assembly has a plurality of hooks slidably mounted along the rail.

BRIEF DESCRIPTION OF THE DRAWINGS

A preferred form of the present invention will now be described by way of example with reference to the accompanying drawings, wherein.

DESCRIPTION OF THE PREFERRED EMBODIMENT

Figure 1:
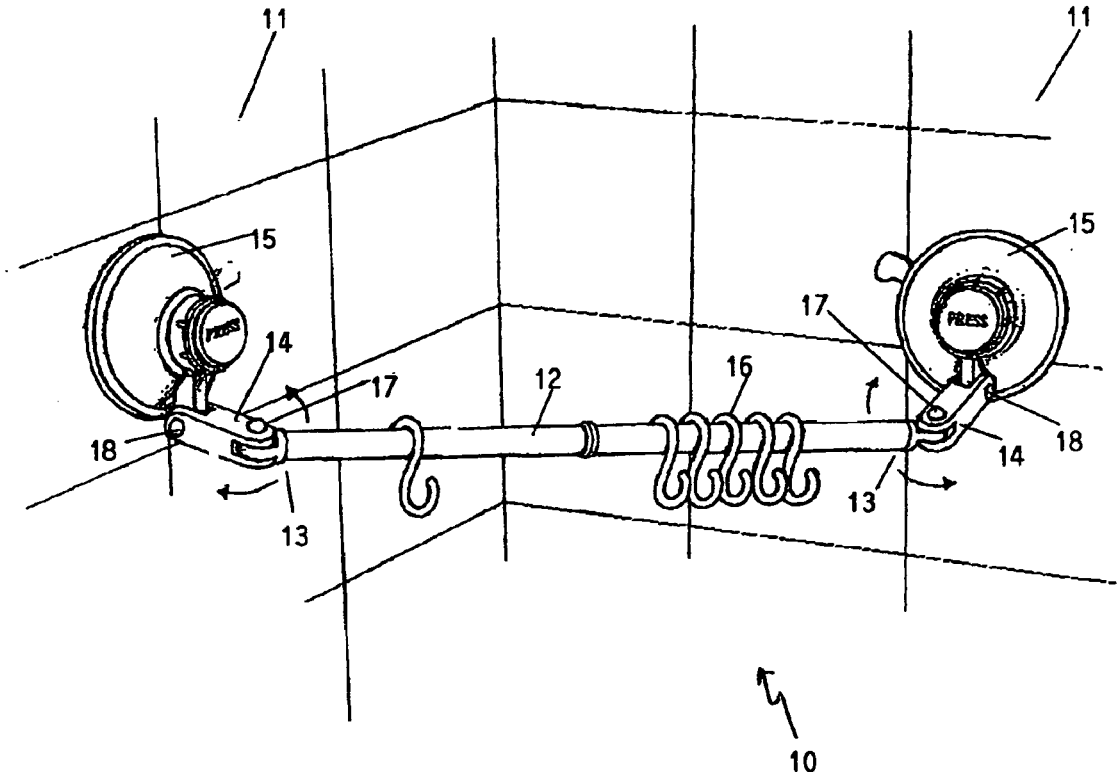
FIG. 1 is a schematic perspective illustration of a bathroom rail assembly attached to wall tiles at the corner of a bathroom or laundry for example.
Figure 2:
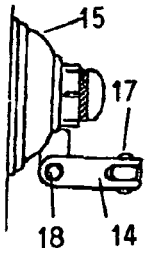
FIG. 2 is a schematic side elevation of a suction fastening device and intermediate link.
Figure 4:
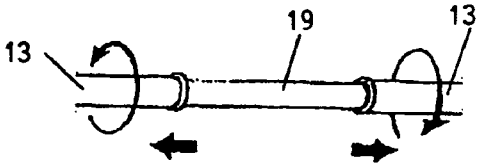
FIG. 4 is a schematic perspective illustration of the bathroom rail extended in telescopic fashion.
Figure 3:
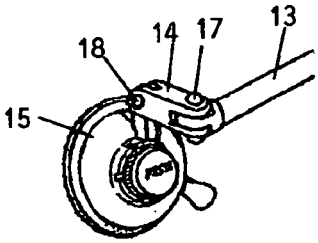
FIG. 3 is a schematic perspective illustration of one suction fastening device in an inverted wall-attached orientation.

In the accompanying drawings there is depicted schematically a bathroom rail assembly 10 a fixed to wall tiles 11 at the corner of a bathroom. The assembly 10 comprises a telescopically extendable rail 12 having pivotally attached at each of its ends 13 an intermediate link 14. Each intermediate link 14 is in turn attached pivotally to a suction fastening device 15 by which the assembly is attached to the wall tiles. A "PRESS" button is provided upon each suction fastening device to secure the assembly to the wall tiles.

There is a plurality of hooks 16 positioned along the rail 12 to which items can be attached for drying. The hooks can slide along the rail 12 as desired.

Each intermediate link 14 has a pivot pin 17 at one end by which the link is pivotally attached to one of the rail ends 13. Each intermediate link also includes another pin 18 by which the link is attached pivotally to the respective suction fastening device 15. As can be seen in FIG. 1, the respective axes of pins 17 and 18 are offset by 90 degrees with respect to one another. This provides multiple degrees of freedom in positioning the suction fastening devices upon a wall or walls.

The length of the rail 12 can be extended by grasping the respective end portions 13, turning in opposite directions and pulling to reveal a midsection 19. There might be provided internal thread or other engagement means internally of the respective end portions 13 that interact with corresponding features on the external surface of the midsection 19 to enable it to be released as desired.

In use, the assembly can be attached to a single wall or a pair of adjoining walls nearby a corner. The corner need not be a 90 degree corner and the suction fastening devices need not be exactly level with one another.

It should be appreciated that modifications and alterations obvious to those skilled in the art are not to be considered as beyond the scope of the present invention. For example, the intermediate links could be longer than those depicted in order to offset the ends of the rail further from the wall. Furthermore, instead of being angularly offset from one another, the pivot pins of the intermediate member could be parallel to one another.

The invention claimed is:

1. A bathroom rail assembly comprising a rail having opposed ends, each of which is attached to a respective suction fastening device by which the rail assembly can be attached to a fixed surface, wherein each suction fastening device has attached pivotally thereto an intermediate link that is in turn attached pivotally to a respective one of said opposed ends of the rail.

2. The assembly of claim 1, wherein the rail comprises two or more telescopically interacting tubular members.

3. The assembly of claim 1, wherein each intermediate link comprises a pair of opposed pivot—pins one at each end thereof, one pin serving to attach the link to a respective said suction fastening device and the other pin serving to attach the link to the respective said rail end.

4. The assembly of claim 3, wherein the respective axes of the pivot pins are angularly offset from one another.

5. The assembly of claim 4, wherein said angular offset is approximately 90 degrees.

6. The assembly of claim 1 having a plurality of hooks slidably mounted along the rail.

* * * * *